US007555853B2

(12) United States Patent
Paonessa

(10) Patent No.: US 7,555,853 B2
(45) Date of Patent: Jul. 7, 2009

(54) SNOW PLOW ASSEMBLY WITH RESILIENT SNOW PLOW BLADE MOUNTING STRUCTURE

(75) Inventor: Gino Paonessa, Oakville (CA)

(73) Assignee: Adepco Technologies Corp. (CA)

( * ) Notice: Subject to any disclaimer, the term of this patent is extended or adjusted under 35 U.S.C. 154(b) by 106 days.

(21) Appl. No.: 11/600,804

(22) Filed: Nov. 17, 2006

(65) Prior Publication Data

US 2008/0115393 A1 May 22, 2008

(51) Int. Cl.
*E01H 5/04* (2006.01)
*E02F 3/76* (2006.01)

(52) U.S. Cl. ..... 37/232; 37/231; 37/446; 172/811; 172/261

(58) Field of Classification Search ..... 37/231, 37/232, 233, 446; 172/810, 811, 816, 827, 172/261, 269, 270–272
See application file for complete search history.

(56) References Cited

U.S. PATENT DOCUMENTS

| | | | | | |
|---|---|---|---|---|---|
| 2,095,096 | A * | 10/1937 | Humphrey | 37/232 |
| 3,604,131 | A * | 9/1971 | Bogenschutz et al. | 37/232 |
| 3,650,054 | A * | 3/1972 | Hanson | 37/232 |
| 3,659,363 | A * | 5/1972 | Snyder | 37/231 |
| 3,808,714 | A * | 5/1974 | Reissinger et al. | 37/233 |
| 3,831,689 | A * | 8/1974 | Smith | 180/313 |
| 4,215,494 | A * | 8/1980 | Farrell et al. | 37/236 |
| 4,259,794 | A * | 4/1981 | Rath | 37/233 |
| 4,307,523 | A * | 12/1981 | Reissinger et al. | 37/233 |
| 4,324,055 | A * | 4/1982 | Hippensteel et al. | 37/283 |
| 5,025,577 | A * | 6/1991 | Verseef | 37/280 |
| 5,191,729 | A * | 3/1993 | Verseef | 37/232 |
| 5,437,113 | A * | 8/1995 | Jones | 37/233 |
| 5,697,172 | A * | 12/1997 | Verseef | 37/232 |
| 5,815,957 | A * | 10/1998 | McKeown | 37/280 |
| 6,484,813 | B2 * | 11/2002 | Tapio et al. | 172/701.1 |
| 6,516,543 | B1 * | 2/2003 | Bishop et al. | 37/219 |
| 6,594,923 | B1 * | 7/2003 | Kost et al. | 37/231 |
| 6,895,698 | B2 * | 5/2005 | Hollinrake et al. | 37/231 |
| 7,107,709 | B2 * | 9/2006 | Hamel | 37/232 |
| 7,263,789 | B2 * | 9/2007 | Hollinrake et al. | 37/231 |

FOREIGN PATENT DOCUMENTS

| | | | |
|---|---|---|---|
| DE | 3205973 | A1 * | 9/1983 |
| DE | 3205974 | A1 * | 9/1983 |

* cited by examiner

*Primary Examiner*—Thomas A Beach
(74) *Attorney, Agent, or Firm*—Alexander Ross, Esq.; Steven M. Greenberg, Esq.; Carey Rodriguez Greenberg & Paul LLP

(57) ABSTRACT

A snow plow assembly with a longitudinally extending plow body has a blade mounting structure that supports a longitudinally extending plow blade. The blade mounting structure has a series of hinges that receive a longitudinally extending pivot rod to couple the plow body to the snow blade and set of springs to bias the snow plow blade into an operative position and to resiliently restore the snow plow blade to the operative position after encountering an obstacle. The hinge portions fixed to the snow plow body each have a receiving slot to slidingly receive a hinge key and the hinge keys define a bearing surface for abutting one end of the coil spring. A locating notch is provided in the hinge keys to limit relative movement between a hinge key an associated hinge portion. A hinge lock to capture the pivot rod is also provided.

2 Claims, 7 Drawing Sheets

52
56

64
63
66
60
58
A
78b
62
B
78a
50
68
74
94
82
84
70
88
78
72
113
86
80

110

SNOW PLOW ASSEMBLY WITH RESILIENT SNOW PLOW BLADE MOUNTING STRUCTURE

FIELD OF INVENTION

This invention relates to a snow plow assembly and particularly relates to a mounting structure for resiliently coupling and locking a snow plow blade to a snow plow body.

BACKGROUND OF THE INVENTION

It is not uncommon for a snow plow to strike obstacles during snow clearing operations such as frozen debris or objects buried beneath the snow such as road curbs and manhole covers. For this reason, snow plow blades are mounted to snow plow bodies with a resilient trip mechanism that allows a snow plow blade to yield upon striking such obstacles and to be restored to an operative position after encountering an obstacle.

In known blade mounting structures the plow body is coupled to the blade by a series of hinges. Spring coils disposed between the hinge portions urge the snow plow blade in a forward operative position to resiliently restore the snow plow blade to an operative position after encountering an obstacle.

An object of this invention is to minimize the cost and labor involved in welding and assembly of the hinges to the plow body. Advantageously, the blade mounting structure according to the invention may be locked to prevent tripping of the blade.

SUMMARY OF THE INVENTION

In accordance with this invention, there is provided a snow plow assembly having a longitudinally extending plow body, and a blade mounting structure mounted to the plow body which supports a longitudinally extending plow blade. The blade mounting structure has a series of hinges that receive a longitudinally extending pivot rod to couple the plow body to the snow plow blade and spring biasing means are disposed therebetween to bias the snow plow blade into an operative position and to resiliently restore the snow plow blade to the operative position after encountering an obstacle.

Hinge portions fixed to the snow plow body each have a receiving slot to slidingly receive a hinge key and the hinge keys define a bearing surface for abutting one end of the spring biasing means. A locating notch is provided in the hinge keys to limit relative movement between a hinge key and an associated hinge portion.

Optionally, a blade mounting kit is provided including a series of hinge portions for coupling to a plow body, a corresponding number of hinge portions for coupling to a snow plow blade, at least one pivot rod, and a corresponding number of spring biasing means.

The blade mounting kit may be supplemented with a series of hinge locks corresponding in number to the hinge portions. The hinge locks have a receiving slot to capture the pivot rod and define a bearing surface for abutting the push channel of a plow body.

BRIEF DESCRIPTION OF THE DRAWINGS

In order that the invention can be more clearly understood, a preferred embodiment is described below with reference to the accompanying drawings, in which.

DESCRIPTION OF PREFERRED EMBODIMENT WITH REFERENCE TO DRAWINGS

Figure 1:
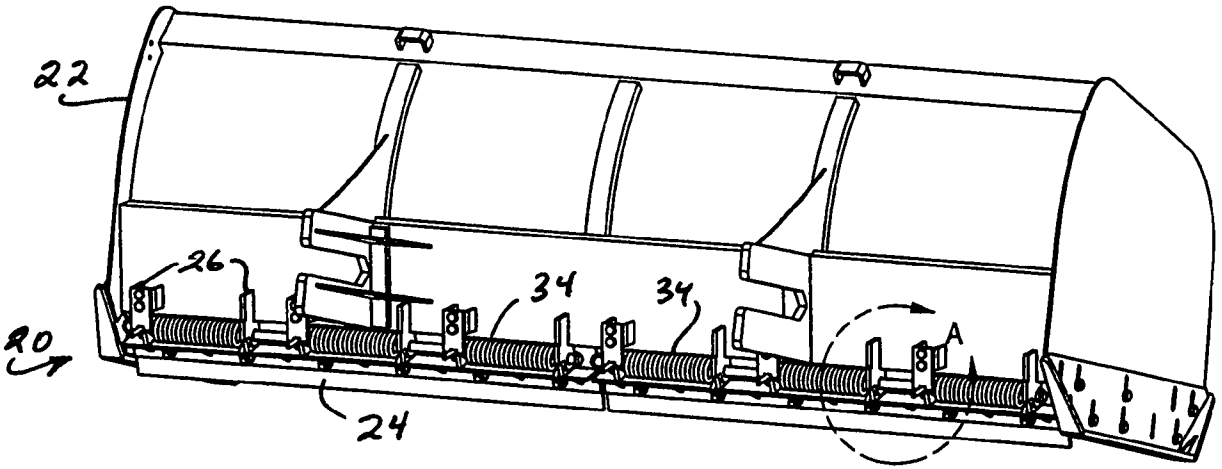
Fig 1 (Prior Art)
FIG. 1 is a perspective view from the rear of a snow plow assembly in accordance with the prior art.
Figure 2:
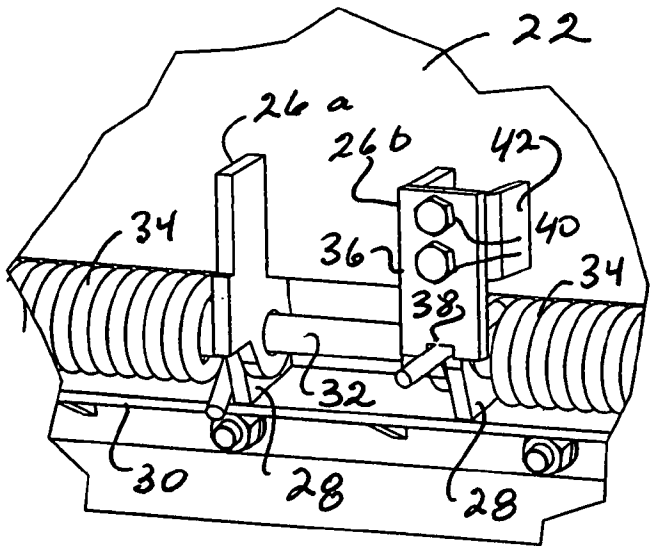
Fig 2 (Prior Art)
FIG. 2 is a detail view of circled area A in FIG. 1.

In one known blade mounting structure 20 illustrated in FIGS. 1 and 2, the plow body 22 is coupled to the blade 24 by a series of hinges having a first set of hinge portions 26 welded to the plow body and a second set of hinge portions 28 welded to a mounting bracket 30 for the snow plow blade, the hinges receiving a pivot rod 32 therethrough. A set of spring coils 34 disposed between the hinge portions 26, 28 urges the snow plow blade 24 in a forward operative position to resiliently restore the snow plow blade to an operative position after encountering an obstacle.

The first set of hinge portions 26 has passive hinge portions 26*a* which merely receive the pivot rod 32 and active hinge portions 26*b* which also provide a bearing surface for one end of the coil spring 34. The active hinge portion 26*b* consists of a notched plate 36, in which the notch 38 locates the coil spring 34. This notched plate 36 is mounted with bolts 40 to a U-shaped channel 42 which is welded to the plow body 22.

In accordance with this invention, there is provided a snow plow assembly which is generally indicated by reference numeral 50 in the accompanying drawings. The snow plow assembly includes a longitudinally extending plow body 52 which is shaped into a so-called "box-frame" having a back side or mould board 54 and a pair of spaced parallel lateral sides 56. As in common practice the mould board 54 and sides 56 are made from the thin sheet metal. The mould board 54 is somewhat curved forwardly and is reinforced with vertically extending reinforcement ribs 58. A top edge of the mould board 54 is fitted with a pair of longitudinally spaced handles 60 welded to a top reinforcement plate for lifting the snow plow assembly 50 by means of a crane or the like in order to load and off load the snow plow assembly on delivery of same. However, during day to day use, the snow plow assembly 50 is moved by means of a vehicle which pushes the plow body forwardly by engaging a pair of rearwardly extending receiver plates 62 that are longitudinally spaced on a push channel 63 welded to the plow body 52 and form part of a receiver system.

In use, the lateral sides 56 of the plow body 52 slide with their bottom edges against a surface being cleared and are reinforced with wear shoes 64. The wear shoes 64 are releasably coupled to the lateral sides 56 by means of mounting bolts received in a plurality of vertically extending mounting slots provided in the wear shoe body.

A longitudinally extending snow plow blade 66 is coupled to the plow body 52 at a bottom edge thereof and is usually formed of heat treated steel in order to make it more resistant to the constant wear arising from scraping a road surface or the like.

As described, snow plow blades are mounted to snow plow bodies with a resilient trip mechanism that allows the snow plow blade to yield upon striking obstacles and to be restored to an operative position after encountering such an obstacle. Since the snow plow blade is normally moved by the vehicle in a forward direction, the snow plow blade is biased to a forward operative position. This invention is directed to the blade mounting structure generally indicated in the drawings by reference numeral 68 whereby the snow plow blade 66 is resiliently mounted to the snow plow body 52.

Figures 3, 4, 5:
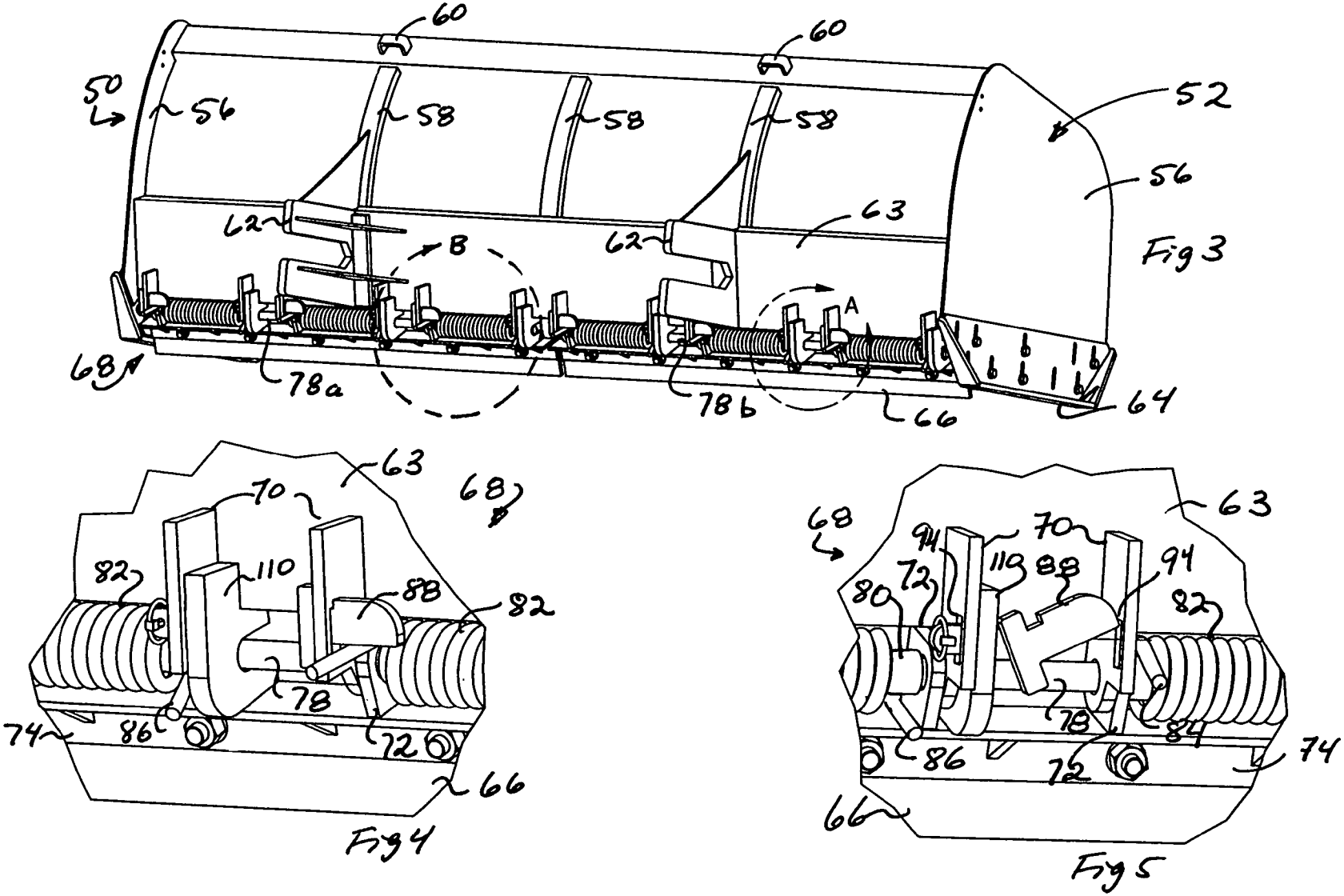
FIG. 3 is a perspective view from the rear of a snow plow assembly in accordance with the invention.
FIG. 4 is a detail view of circled area A in FIG. 3.
FIG. 5 is an exploded view of FIG. 4 showing a hinge key being assembled with a hinge portion.
Figure 9:
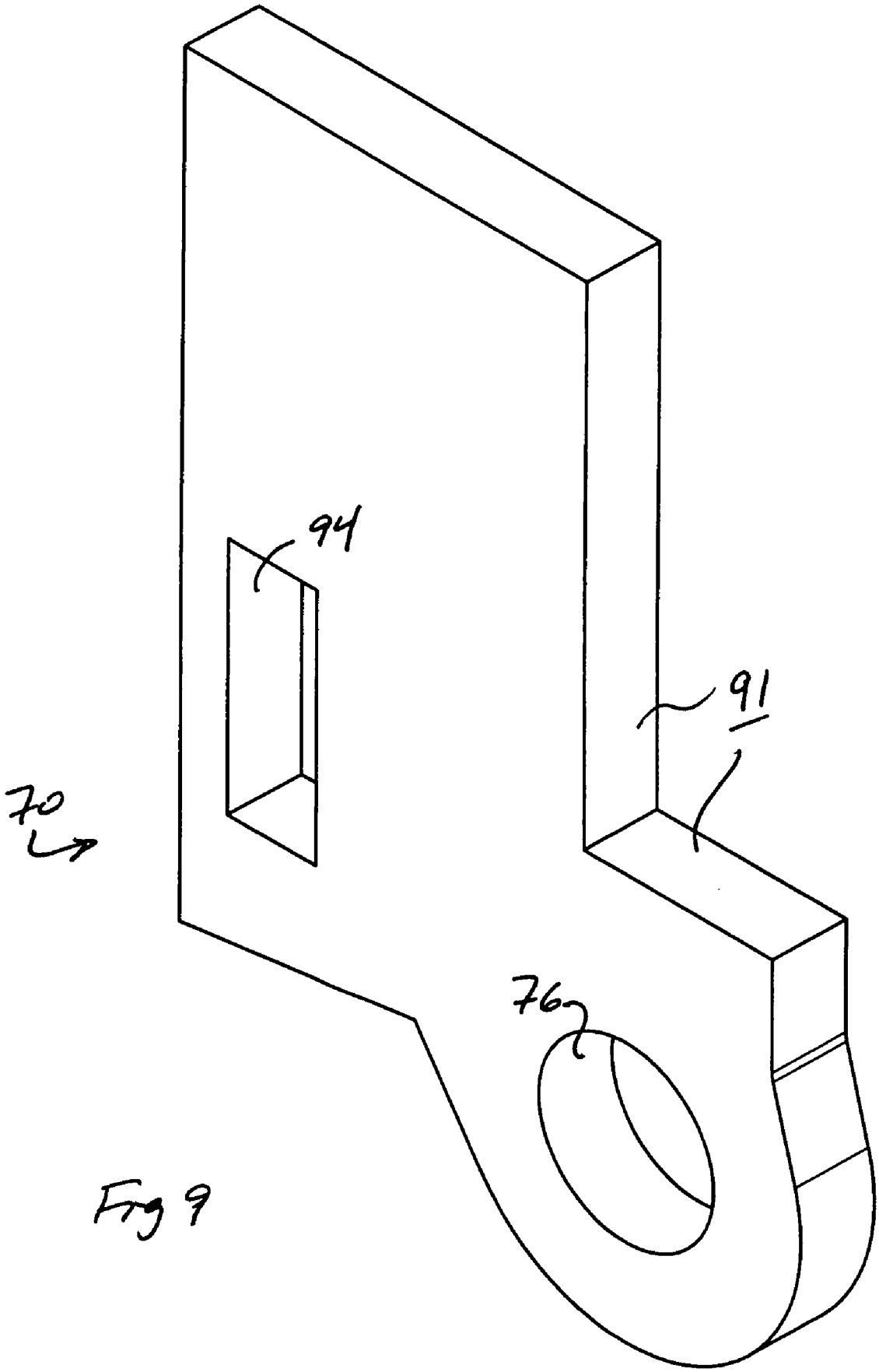
FIG. 9 is a perspective view of a hinge portion.

The blade mounting structure 68 comprises a first series of longitudinally spaced hinge portions 70 that are coupled to the push channel 63 by welding as shown more clearly in FIG. 4 of the drawings. A second series of longitudinally spaced hinge portions 72 is coupled by welding to a mounting bracket 74 for the snow plow blade 66. Each of the hinge portions 70, 72 has a respective rod aperture 76 (FIG. 9) which slidingly receives a longitudinally extending pivot rod 78. Depending on the length of the snow plow body 52, the pivot rod 78 may be provided in sections in order to span the length of the plow. In the embodiment illustrated in FIG. 3, two such sections are provided and the pivot rod is indicated accordingly by reference numerals 78*a* and 78*b*.

The rod 78 is preferably covered by a cylindrical sleeve 80 (FIG. 7) in sections which extend between pairs of the hinge portions 70 and which are surrounded by a respective coil spring 82 disposed around each cylindrical sleeve section. The cylindrical sleeves 80 thereby operate as a bushing to prevent the coil spring 82 from binding on the pivot rod 78. The coil spring biasing means are disposed between the first series of longitudinally spaced hinge portions 70 and the second series of longitudinally spaced hinge portions 72 in order to urge the snow plow blade 66 in a forward operative position and to resiliently restore the snow plow blade to an operative position after encountering an obstacle. As can be seen most clearly in FIG. 8, each coil spring has first and second ends 84, 86 of which the first end 84 bears against a channel hinge portion 70 via a hinge key 88 and of which the second end 86 bears against the mounting bracket 74.

Figures 6, 7:
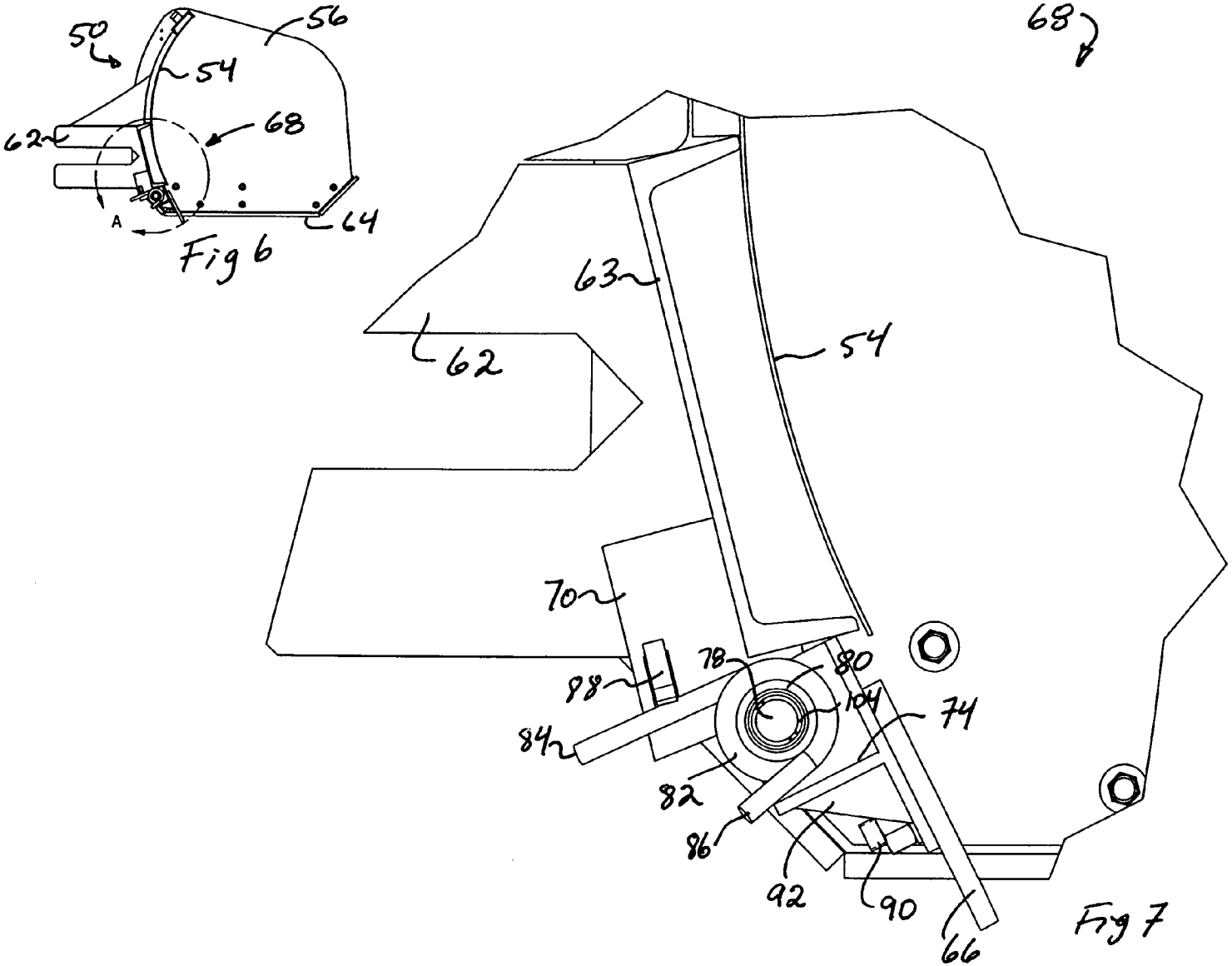
FIG. 6 is a side elevation view of a snow plow assembly in accordance with the invention.
FIG. 7 is a detail view of circled area A of FIG. 6.

As can be seen in the end elevation of FIG. 7, the mounting bracket 74 has a T-shaped cross-section and a number of longitudinally spaced bolts 90 are used to secure the snow plow blade 66 at the bottom edge of the mounting bracket 74. A plurality of fillets 92 are welded along the length of the mounting bracket 74.

It will be observed that the first hinge portion 70 is cut from a plate of plain carbon steel which is welded on orthogonal bearing surfaces 91 to the push channel 63 of the snow plow body 52. In proximity to the rod aperture 76, the first hinge portion 70 has a receiving slot 94 which is formed to extend vertically and to slidingly receive the aforementioned hinge key 88. A series of hinge keys 88 are provided to cooperate with the first hinge portions 70. However, only half of the hinge portions 70 require a hinge key for coupling to the first end 84 of the coil spring 82, the other half of the hinge portions 70 being disposed adjacent the second free end 86 of the coil spring 82 which bears upon the mounting bracket 74.

Figure 10:
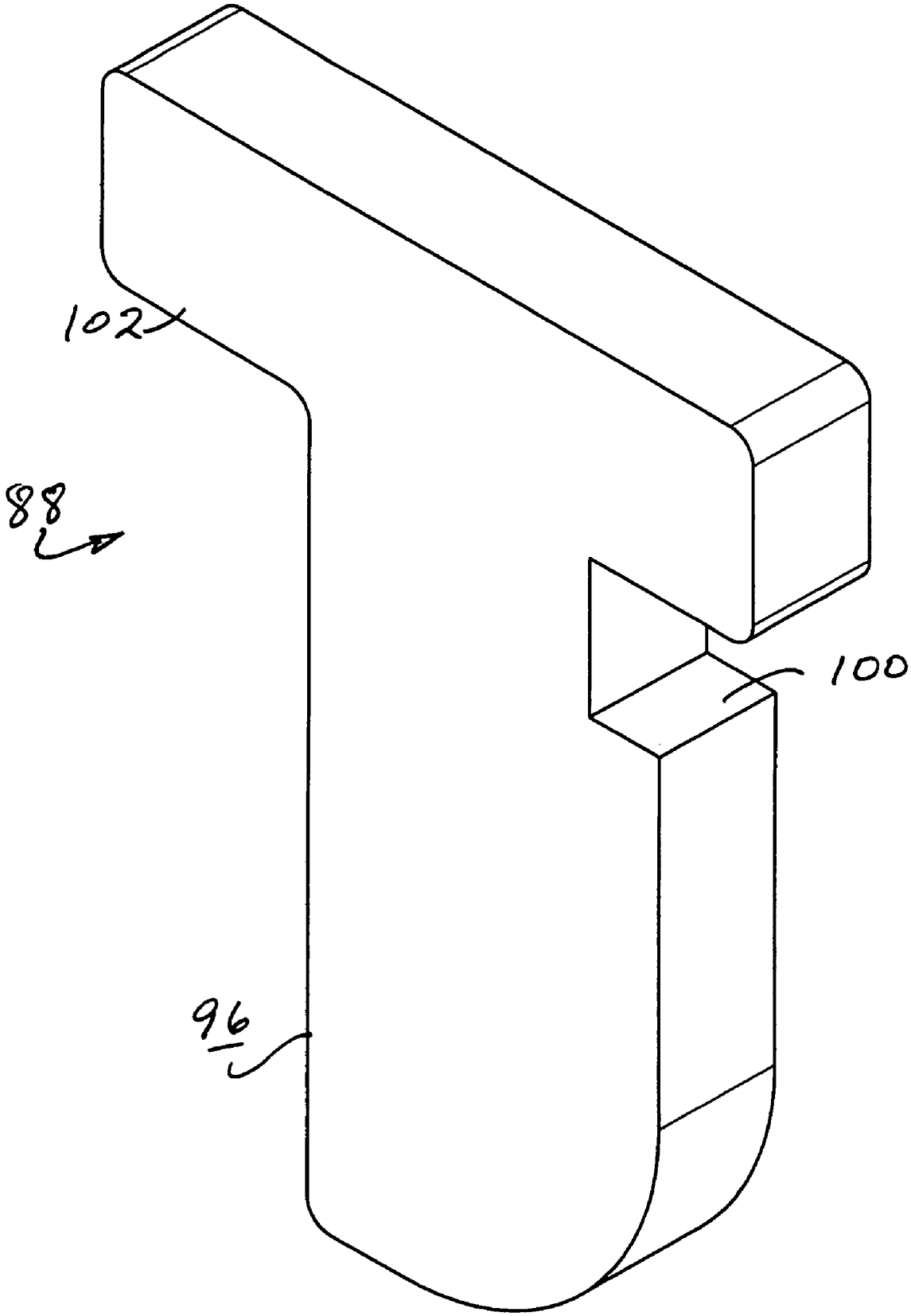
FIG. 10 is a perspective view of a hinge key.

The structure of the hinge key 88 can be seen more clearly in FIG. 10. The hinge key 88 is made from plain carbon steel like the first hinge portion 70. As can be seen in FIGS. 4 and 5, the hinge key 88 is inserted into the receiving slot 94 to come to a rest position where a bearing surface 96 abuts the first end 84 of the coil spring 82. Opposite from the bearing surface 96, a notch 100 is formed in the hinge key 88 so that opposing shoulders of the notch 100 are disposed on opposite sides of the first hinge portion 70 to limit relative movement between the hinge key 88 and the hinge portion 70. For added security, and to prevent accidental release of the spring coil 82 from the preloaded condition shown in the drawings, the hinge key 88 includes a second shoulder 102 formed on the same side as the bearing surface 96 and opposite from the notch 100 thereby forming the top portion of a "T" shaped hinge key.

In use, the blade mounting structure 68 is assembled as described above to couple the snow plow blade 66 to the snow plow body 62. The pivot rod 78 is inserted between first and second hinge portions 70 and 72 and the sleeves 80 and coil springs 82 are slid over the pivot rod 78 as it progresses along the length of the snow plow body between the hinge portions. A specialized tool (not shown) is used to pre-stress the coil springs 82 thereby allowing sufficient clearance to insert the hinge keys 88 in respective receiving slots 94 so as to abut the free end 84 of the coil springs. After the assembly is completed, a locating ring 104 is positioned in receiving apertures formed at each end of the pivot rod 78 so as to secure the assembly. It will be understood that the receiving slot 94 has a sufficient length to accommodate both the width of the hinge key 88 and an additional clearance sufficient to pre-load the coil spring 82 to a desired value. In this way, the snow plow blade 66 is forwardly biased into an operative position and the coil spring may resiliently restore the snow plow blade into an operative position after encountering an obstacle.

Optionally, a blade mounting kit is provided including a series of first hinge portions 70 for coupling to a plow body, a corresponding number of hinge portions 72 for coupling to a snow plow blade, at least one pivot rod 78, and a corresponding number of spring biasing means 82.

Figure 8:
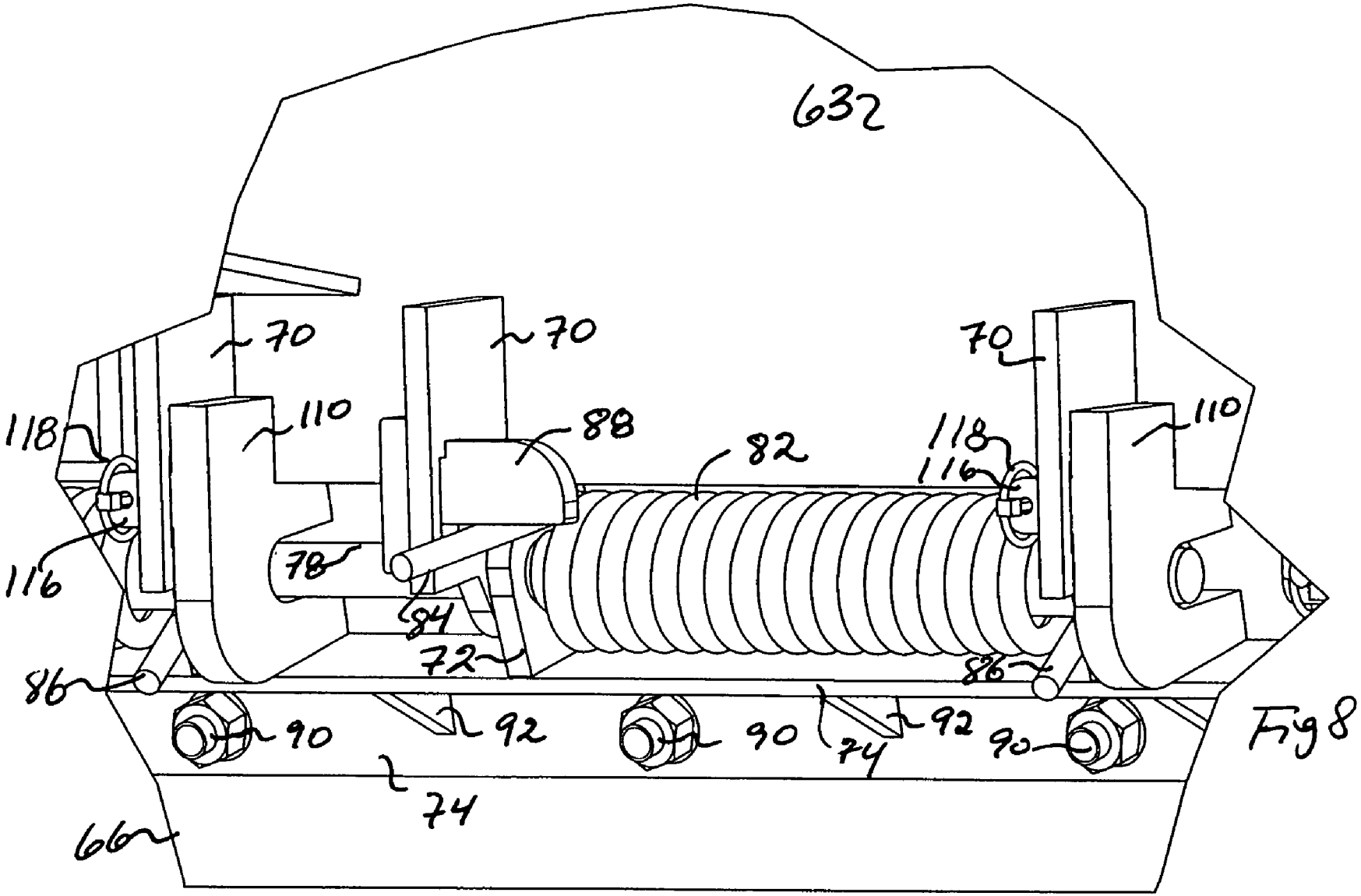
FIG. 8 is a perspective view from the rear of circled area B of FIG. 3 drawn to larger scale.
Figure 11:
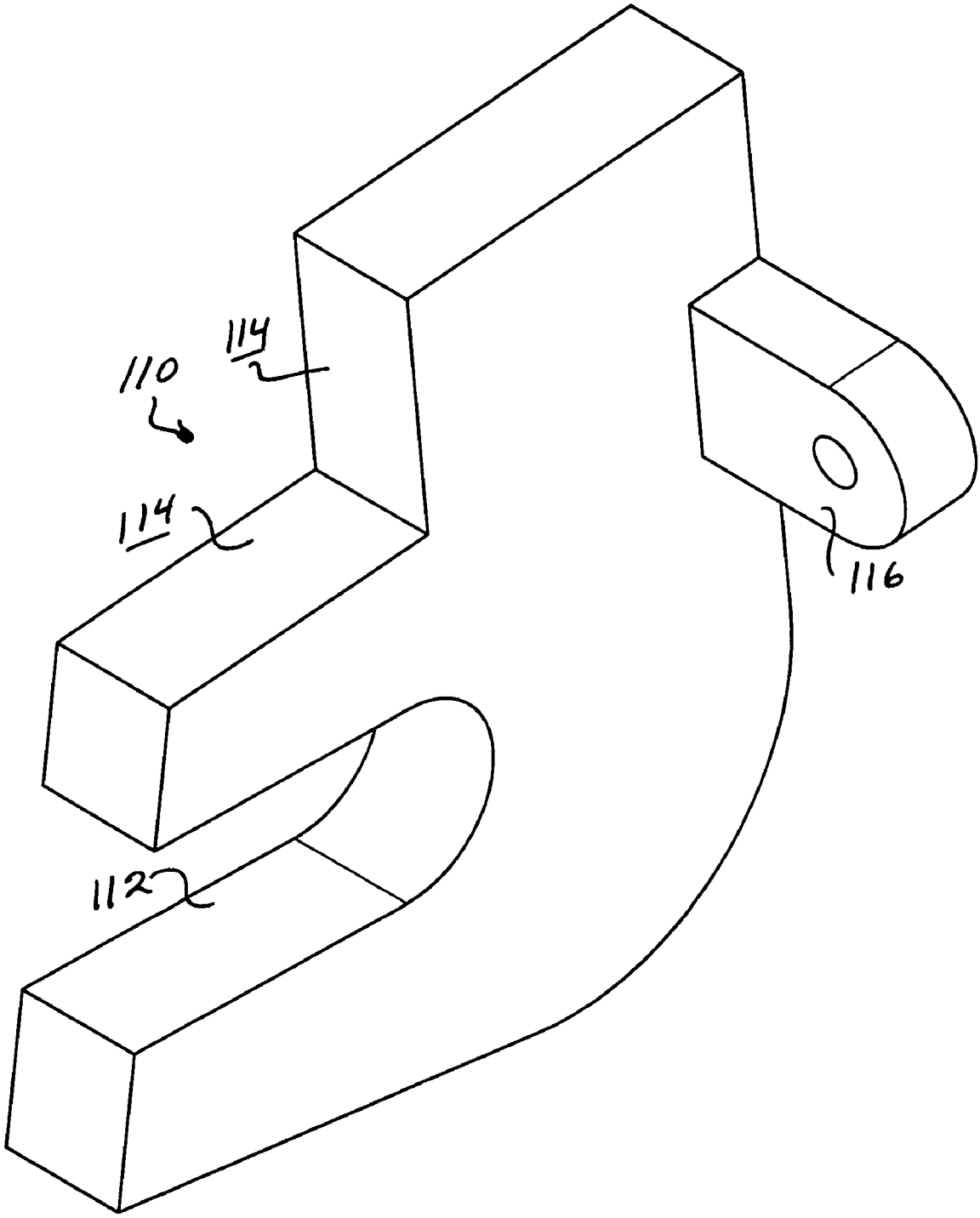
FIG. 11 is a perspective view of a hinge lock.

The blade mounting kit may be supplemented with a series of hinge locks 110 (shown in more detail in FIG. 11) corresponding in number to the hinge portions. The hinge locks 110 have an open receiving slot 112 to capture the pivot rod 78 and the hinge lock defines a pair of orthogonal bearing surfaces 114 for abutting the push channel 63. The hinge locks 110 are installed between the first hinge portions 70 as shown in FIGS. 4, 5 and 8 where the pivot rods 78 are exposed and adjacent to a hinge portion 70 that is disposed adjacent to the second free end 86 of a coil spring 82. They are useful in situations where the snow plow blade is used to scrape icy surfaces and it is desirable to prevent the snow plow blade from tripping. An apertured lug 116 fixed to the hinge lock extends transversely through the receiving slot 94 of an adjacent hinge portion 70 to receive a locking ring 118.

It will be understood that several variations within the scope of the appended claims may be made to the above-described embodiment of the invention as will be apparent to those skilled in the art.

The invention claimed is

1. A snow plow assembly having a longitudinally extending plow body with a receiver extending from a back side of the plow body for coupling the snow plow assembly to a vehicle, a blade mounting structure mounted to the plow body which supports a longitudinally extending snow plow blade at a bottom edge of the plow body, the blade mounting structure having:

a first series of longitudinally spaced hinge portions coupled to the plow body, said hinge portions each having respective rod apertures;

a second series of longitudinally spaced hinge portions coupled to a mounting bracket for the snow plow blade, said hinge portions each having respective rod apertures;

at least one longitudinally extending pivot rod received through said rod apertures of said first and second series of longitudinally spaced hinge portions thereby coupling the plow body to the mounting bracket;

coil spring biasing means disposed between said first series of longitudinally spaced hinge portions and said second series of longitudinally spaced hinge portions on said at least one longitudinally extending pivot rod, to urge said snow plow blade in a forward operative position and to resiliently restore the snow plow blade to an operative position after encountering an obstacle;

the first series of longitudinally spaced hinge portions each having a receiving slot to slidingly receive a respective hinge key;

a series of hinge keys co-operating with said first series of longitudinally spaced hinge portions to be received in said receiving slots, said hinge keys defining a bearing surface for abutting one end of said coil spring biasing means, each said hinge key further having a locating notch to limit relative movement between the hinge key and the hinge portion, and;

a series of hinge locks, each hinge lock having a receiving slot to capture a pivot rod and defining a bearing surface for abutting the plow body.

2. A blade mounting kit for replacing a snow plow blade on a snow plow, the kit having:

a first set of hinge portions for coupling to a snow plow body, the hinge portions each having respective rod apertures for slidingly receiving a pivot rod therethrough and a receiving slot to slidingly receive a respective hinge key;

a number of hinge keys adapted to be received in a respective receiving slot, the hinge keys defining a bearing surface for abutting one end of coil spring biasing means, each hinge key having a locating notch to limit relative movement between the hinge key and a corresponding hinge portion; and a plurality of hinge locks, each hinge lock having an open receiving slot to capture a pivot rod and defining a bearing surface for abutting a snow plow body.

* * * * *